US007165709B2

(12) United States Patent
Yagi

(10) Patent No.: US 7,165,709 B2
(45) Date of Patent: Jan. 23, 2007

(54) ELECTRICALLY DRIVEN STAPLER

(75) Inventor: Nobuaki Yagi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 10/563,585

(22) PCT Filed: Jul. 6, 2004

(86) PCT No.: PCT/JP2004/009900

§ 371 (c)(1),
(2), (4) Date: Jan. 6, 2006

(87) PCT Pub. No.: WO2005/002799

PCT Pub. Date: Jan. 13, 2005

(65) Prior Publication Data

US 2006/0157530 A1 Jul. 20, 2006

(30) Foreign Application Priority Data

Jul. 7, 2003 (JP) ..... 2003-271627

(51) Int. Cl.
*B25C 5/15* (2006.01)

(52) U.S. Cl. ..... 227/155; 227/131

(58) Field of Classification Search ..... 227/120, 227/131, 154, 155; 173/122, 124, 205
See application file for complete search history.

(56) References Cited

U.S. PATENT DOCUMENTS 3,666,157 A * 5/1972 Kawai et al. ..... 227/131
5,660,314 A * 8/1997 Magnusson et al. ..... 227/2
5,791,543 A * 8/1998 Udagawa et al. ..... 227/4
6,371,352 B1 * 4/2002 Mochizuki ..... 227/155
6,592,115 B2 * 7/2003 Yamaguchi ..... 270/58.08
6,626,348 B2 * 9/2003 Kitamura ..... 227/155
6,811,070 B2 * 11/2004 Takada ..... 227/120
6,820,790 B2 * 11/2004 Ura ..... 227/131
6,892,919 B2 * 5/2005 Higuchi et al. ..... 227/2
6,896,167 B2 * 5/2005 Haramiishi ..... 227/131
6,935,547 B2 * 8/2005 Mochizuki ..... 227/131

FOREIGN PATENT DOCUMENTS

JP A-59-53171 3/1984
JP Y-06-007896 3/1994

* cited by examiner

*Primary Examiner*—Scott A. Smith
(74) *Attorney, Agent, or Firm*—Morgan, Lewis, Bockius, LLP

(57) ABSTRACT

A magazine 5 attached with a cartridge 6, in which connected staples are charged, is supported inside a support frame 4 being capable of moving toward a clincher section 3. A cam follower 17 is formed being protruded from aside of the magazine 5. When this cam follower 17 is engaged with a cam groove 21 formed in a drive rotary member 9 for driving a staple drive mechanism 8 arranged in the support frame 4, the magazine 5 is directly operated toward the clincher section 3 by the drive rotary member 9.

5 Claims, 8 Drawing Sheets

ELECTRICALLY DRIVEN STAPLER

TECHNICAL FIELD

The present invention relates to an electric stapler in which a cartridge charged with connected staples is attached into a magazine of the electric stapler, the connected staples are successively supplied to a drive section formed at the forward end portion of the cartridge, the staples supplied to the drive section are successively driven toward sheets of paper to be stapled, and leg portions of the staple penetrating the sheets of paper to be stapled are bent along a reverse side of the sheets of paper to be staples, so that the sheets of paper to be stapled can be stapled by the staple driven in this way.

BACKGROUND ART

The following electric stapler is well known. Connected staples, in which a large number of straight staple materials are aligned and bonded to each other so that they can be formed into a sheet-shape, are charged into an cartridge. The cartridge is attached into a magazine of the electric stapler. The connected staples are successively supplied from the cartridge to a drive section provided in the forward end portion of the magazine. A lead staple of these connected staples is formed into a U-shape by a forming plate in a drive section. The U-shaped staple is supplied to a drive passage formed in the drive section. The staple is driven from the drive passage by a driver plate sliding in the drive passage, so that legs of the staple are made to penetrate sheets of paper to be stapled arranged below the drive section of the magazine. The legs of the staple, which have penetrated the sheets of paper to be stapled, are bent along the reverse side of the sheets of paper to be stapled by a clincher mechanism arranged below the magazine. Due to the foregoing, the sheets of paper are stapled by the electric stapler.

The magazine of the above electric stapler includes: a drive section, which forms a drive passage for guiding the staple to sheets of paper to be stapled, provided at the forward end portion of the magazine; a staple supply mechanism which supplies the staple charged in the cartridge toward the drive section; and a forming and driving mechanism which forms the staple supplied to the drive section into a U-shape and drives the staple from the drive passage toward the sheets of paper to be stapled, wherein the magazine is arranged being isolated from the clincher mechanism, which bends legs of the staple when the stapler is not operated, by a predetermined space in which the sheets of paper to be staples are arranged. When the electric stapler is operated in order to staple the sheets of paper to be stapled which are arranged in the above space, the magazine is operated in the direction of the clincher mechanism so as to clamp the sheets of paper between the magazine and the clincher mechanism. After that, the forming and driving mechanism of the magazine section is operated so that the staple can be driven to the sheets of paper to be stapled. The magazine of the electric stapler is composed as described above.

The forming and driving mechanism of the magazine of the electric stapler includes: a forming plate for forming a straight staple material of the connected staples, which is supplied to the drive section, into a U-shape; and a driver plate for driving the staple, which has been formed into the U-shape, toward the sheets of paper to be stapled, wherein the driver plate is slidably provided being opposed to the drive passage of the drive section. The forming and driving mechanism is slid in the direction of the clincher mechanism section by a rotary member, which is rotated by an electric motor, via a link member engaged with a cam groove formed in the rotary member. Due to the foregoing, the staple material is formed into a U-shape and driven out from the drive passage. When the forming and driving mechanism held by the magazine is driven in the direction of the clinch mechanism, the magazine is operated in the direction of the clincher mechanism by a sliding resistance between the forming and driving mechanism and the magazine while the magazine is following the forming and driving mechanism.

In the conventional electric stapler, the rear end portion of the magazine is pivotally supported by a rotary support shaft inside the support frame, and the magazine section is driven by the sliding resistance with the forming plate and the driver plate which are driven for driving out the staples provided in the magazine. Therefore, when the rotary resistance of the magazine is increased by the abrasion and deformation caused while the electric stapler is being used, it becomes difficult for the magazine to be rotated and the staple is driven out from the magazine section to the sheets of paper to be stapled by the driver plate before the lower face of the magazine is tightly contacted with the sheets of paper to be stapled. In this state, no guide is provided for guiding the staple legs between the surface of the sheets of paper to be stapled and the drive passage of the staples. Therefore, buckling is generated in the staple legs and failure in stapling is caused.

When the magazine is operated by an elastic force of the compression spring provided between the link, which drives the driver plate, and the magazine as described in JP-Y-06-007896, even if the operational resistance of the magazine is increased a little, the magazine can be operated before the staple is driven out by the driver plate. However, in this electric stapler, the magazine of which is vertically operated with respect to the surface of the sheets of paper to be stapled so that the electric stapler can cope with fluctuation of the thickness of the sheets of paper to be stapled, the sliding resistance generated between the support frame, which slidably supports the magazine, and the magazine, is increased. Therefore, in order to positively operate the magazine by the compression spring, it is necessary to set the elastic force of the compression spring at a high value. Therefore, the forming plate and the driver plate must be operated overcoming the spring force of this high value, which increases a load given to the drive motor. Accordingly, a large drive motor is required and a drive current to drive the motor is increased, which makes it impossible to save electric power.

DISCLOSURE OF THE INVENTION

The present invention has been accomplished to solve the above problems of the prior art. It is a task of the present invention to provide a drive mechanism for driving an electric stapler in which a magazine is operated in the direction of a clincher mechanism so that sheets of paper to be stapled can be positively clamped between the magazine and the clincher before a staple is driven out from the magazine by the staple drive mechanism.

In order to solve the above problems, an electric stapler mechanism according to the present invention is characterized in that: a magazine attached with a cartridge, into which connected staples are charged, is supported by a support frame so that the magazine can be moved toward a clincher section; a cam follower is formed being protruded from a side of the magazine; a cam groove engaging with the cam follower is formed in a drive rotary member for driving the staple drive mechanism; and the magazine is directly operated toward the clincher by the drive rotary member.

According to the present invention, the magazine is supported by the support frame being capable of moving, the cam follower is formed on the side of the magazine being protruded, and when this cam follower is engaged with the cam groove formed in the drive rotary member for driving the staple drive mechanism arranged on the outer side of the support frame, the magazine can be directly operated by the drive rotary member. Therefore, even when a sliding resistance of the magazine with the support frame supporting the magazine is increased, the magazine is operated in such a manner that the sheets of paper to be stapled are clamped between the magazine and the clincher mechanism before the staple in the magazine is driven. Therefore, it is possible to prevent the occurrence of failure of stapling in which buckling is caused in the staple when the staple is driven out from the magazine before the sheets of paper to be stapled are clamped.

An object of positively clamping sheets of paper by operating the magazine toward the clincher mechanism section before the staple is driven out can be realized by engaging the cam follower, which is formed in the magazine, with the cam groove which is formed in the drive rotary member for driving the staple drive mechanism.

BRIEF DESCRIPTION OF THE DRAWINGS

FIG. 5 is a schematic illustration showing a state of operation right after the stapling operation has been started, wherein FIG. 5 is drawn in the same manner as that of FIG. 4.

FIG. 6 is a schematic illustration showing a state of operation after the stapling operation has been completed, wherein FIG. 6 is drawn in the same manner as that of FIG. 4.

Figure 1:
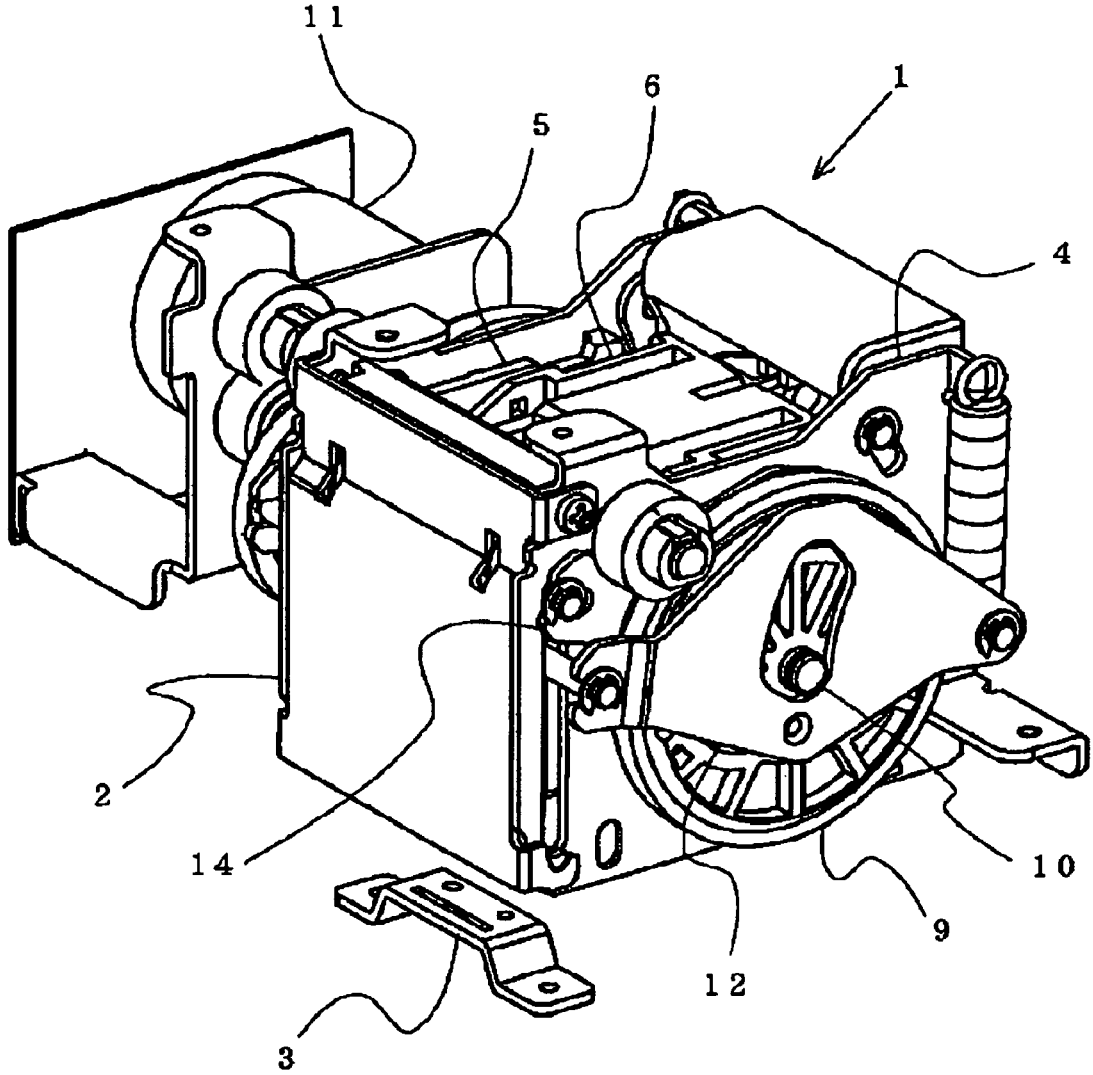
FIG. 1 is a perspective view showing an electric stapler of an embodiment of the present invention.

In this connection, in the drawings, reference numeral 1 is an electric stapler, reference numeral 4 is a support frame, reference numeral 5 is a magazine, reference numeral 7 is a drive section, reference numeral 8 is a staple drive mechanism, reference numeral 9 is a drive rotary member, reference numeral 17 is a can follower, reference numeral 21 is a cam groove, and reference numeral 24 is a staple supply mechanism.

BEST MODE FOR CARRYING OUT THE INVENTION

FIG. 1 is a perspective view showing an entire electric stapler to which the staple supply mechanism of the present invention is applied. The electric stapler 1 is arranged in a conveyance passage for conveying sheets of paper provided in a copier, a printer and so forth. The electric stapler 1 staples a plurality of sheets of paper on which copying or printing has been conducted. In this embodiment, the electric stapler 1 includes: a staple drive section 2 in which the connected staples, formed in such a manner that a large number of straight staple materials are arranged in parallel with each other and the adjoining staple materials are bonded and connected to each other by adhesive so as to be formed into a sheet shape, are supplied to a drive section having an anvil for forming and also having a drive passage for guiding the staple to be driven, and a straight staple material of the lead portion of the connected staples is formed into a U-shape and the thus formed U-shaped staple is driven toward sheets of paper to be stapled; and a clincher section 3 which bends staple legs penetrating the sheets of paper along a reverse side of the sheets of paper to be stapled. The staple drive section 2 is arranged on one side of the conveyance passage for conveying the sheets of paper formed inside a copier or a printer, and the clincher section 3 is arranged on the opposite side to the conveyance passage.

The staple drive section 2 includes: a pair of support frames 4 formed on one side of the conveyance passage for conveying the sheets of paper; a magazine 5 slidably supported between the pair of support frames 4 so that the magazine 5 can be slid toward the sheets of paper arranged in the conveyance passage; and a cartridge 6 attached into the magazine 5, wherein the sheet-shaped connected staples are charged in the cartridge 6. The forward end portion of the cartage 6 includes: an anvil for forming a straight staple material, which is located in the lead portion of the sheet-shaped connected staples, into a U-shape; and a drive section 7 for guiding and driving the staple, which has been formed into the U-shape, toward the sheets of paper to be stapled. The magazine 5 includes: a staple supply mechanism for supplying the connected staples charged in the cartridge 6 toward the drive section 7; and a staple drive mechanism 8 for forming the straight staple material into the U-shape and driving out the U-shaped staple. The drive rotary member 9, on the outer circumference of which teeth are formed, is pivotally supported by the support shaft 10 on the outside of both support frames 4. When the drive rotary member 9 is rotated by the drive motor 11 arranged being adjacent to the support frame 4, the magazine 5 and the staple drive mechanism 8 are driven.

Figure 2:
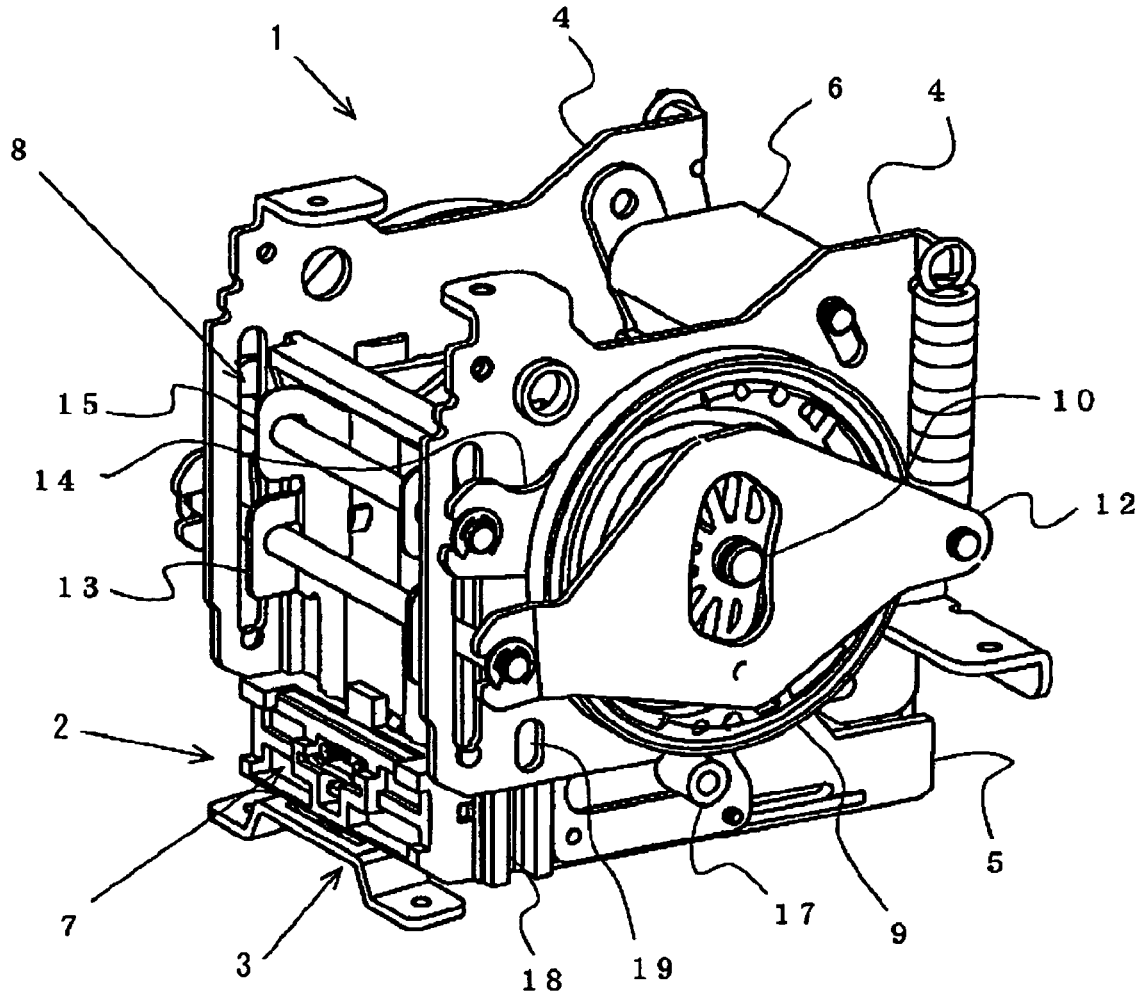
FIG. 2 is a perspective view showing a drive section of the same electric stapler as that shown in FIG. 1.

As shown in FIG. 2, the drive rotary member 9 is pivotally supported by the support shaft 10 outside of both support frames 4. On the outside of each drive rotary member 9, the forming link 12 is arranged. By this forming link 12, the forming plate 13, which is arranged being opposed to the anvil of the drive section 7, is driven. By the driver link 14 arranged on the inside of each drive rotary member 9, the driver plate 15, which is formed being opposed to the drive passage of the drive section 7, is driven. Outside the magazine 5, the cam follower 17 protruding toward the drive rotary member 9 is formed. When this cam follower 17 is engaged with the cam groove formed in the drive rotary member 9, the magazine 5 is operated downward with respect to the support frame 4.

Figure 3:
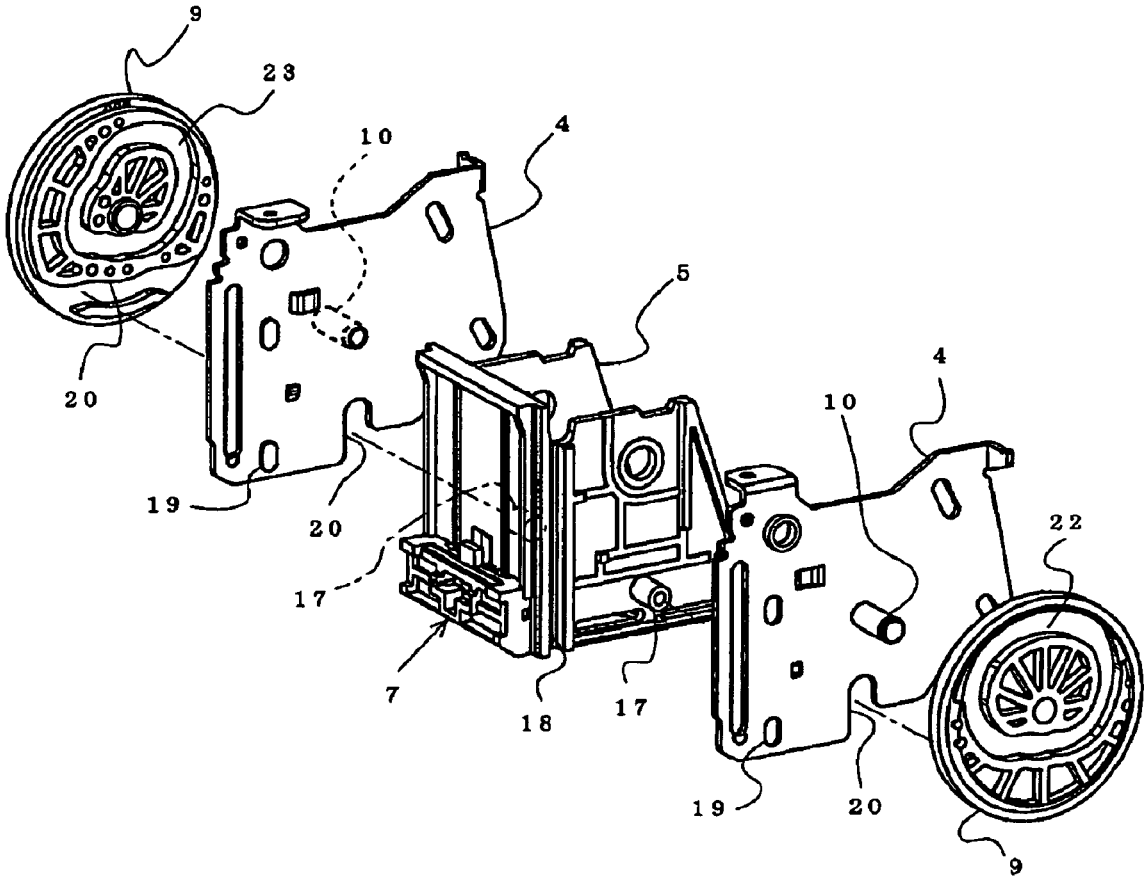
FIG. 3 is an exploded perspective view showing a magazine and parts composing an operation mechanism of the magazine.

As shown in FIG. 3, when the guide groove 18 formed outside the magazine 5 is engaged with the guide protrusion 19 formed inside the support frame 4 as shown in FIG. 3, the magazine 4 is supported being capable of vertically sliding with respect to the support frame 4. The cam follower 17 protruding outside the magazine 5 is protruded from the cutout portion 20 formed in the support frame 4 to the outside of the support frame 4 and engaged with the cam groove 21 formed inside the drive rotary member 9. Due to the above structure, when the drive rotary member 9 is rotated, the magazine 5 is driven downward with respect to the support frame 4. Therefore, the sheets of paper to be stapled are interposed between the magazine section 5 and the clincher section 3.

Figure 4:
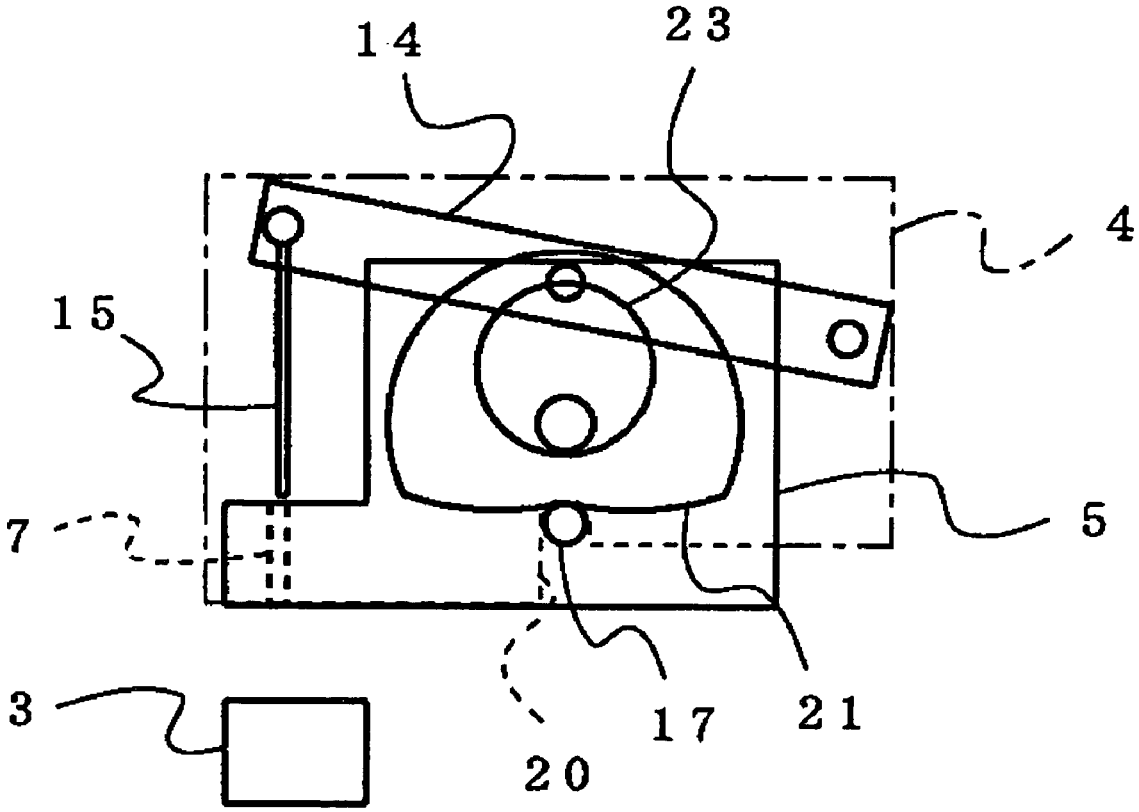
FIG. 4 is a schematic illustration showing a state of operation of the staple drive mechanism, which is not operated, and the magazine.

As shown in FIGS. 2 and 3, outside the drive rotary member 9 arranged outside the support frame 4, the forming cam 22 is provided. When the central portion of the forming link 12, one end of which is connected to the forming plate 13, is engaged with this forming cam 22, the forming plate 13 is driven by the drive rotary member 9. As shown in FIG. 4, the driver cam 23 is formed inside the drive rotary member 9. When the center of the driver link 14 to drive the driver plate 15 is engaged with this driver cam 23, the driver plate 15 is driven by the drive rotary member 9.

Figure 5:
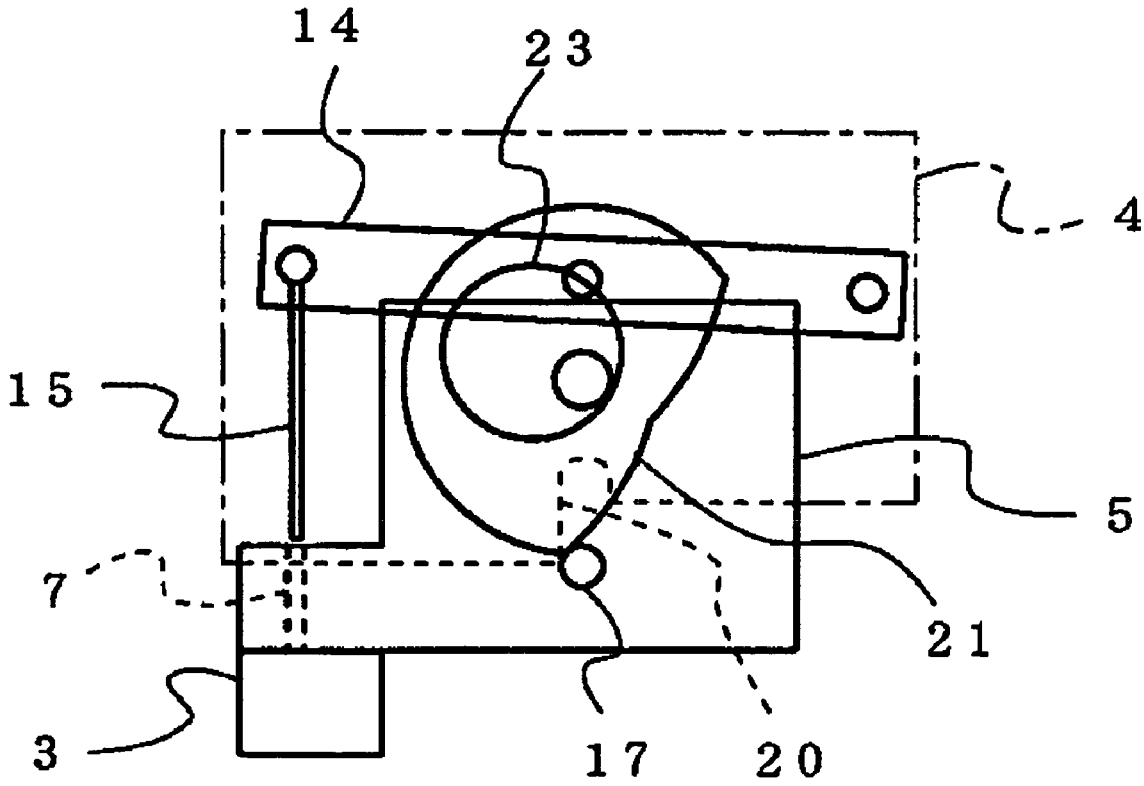
Figure 6:
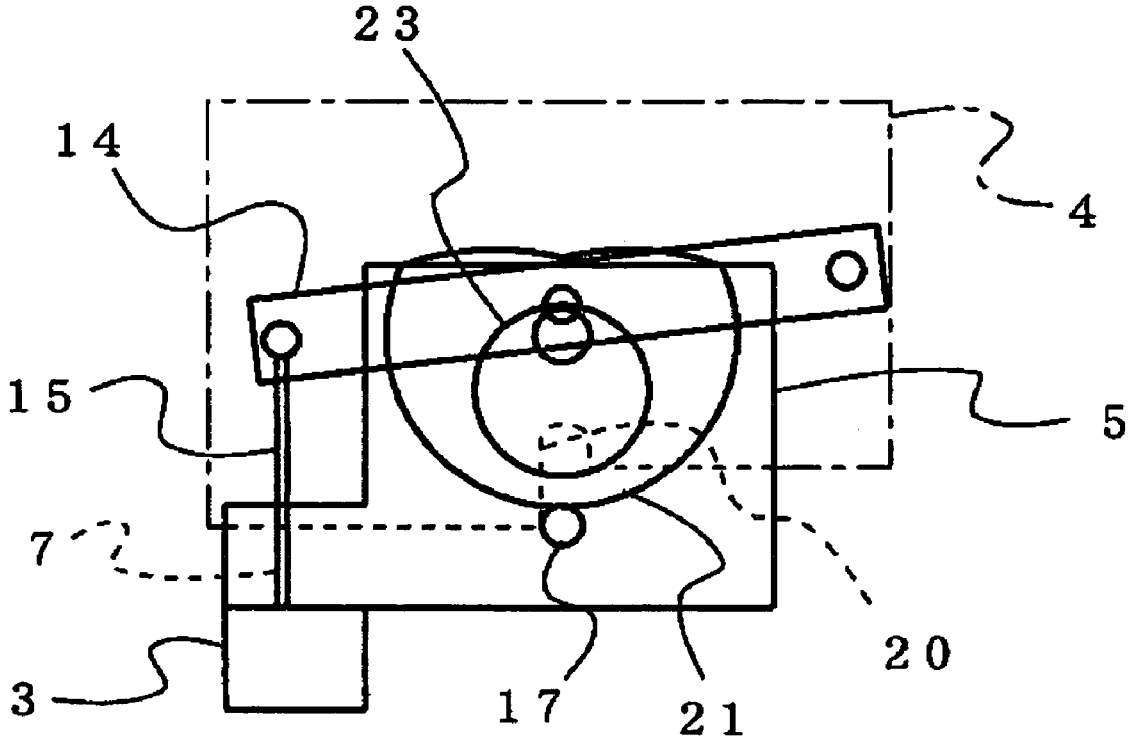

Referring to FIGS. 4 to 6, operation of the magazine 5 and the driver plate 15 composing the staple drive mechanism 8 will be explained below. As shown in FIG. 4, in the state in which the electric stapler 1 is not operated, the magazine 5 is held at an upper position with respect to the support frame 4 by the cam follower 17 and the cam groove 21 formed in the drive rotary member 7 so that a gap into which the sheets of paper to be stapled can be inserted can be formed between the magazine 5 and the clincher section 3. Concerning the driver plate 15 connected to a forward end portion of the driver link 14, the center of the driver link 14 is engaged with the driver cam 23, and the driver plate 15 is located at an upper waiting position.

As shown in FIG. 5, when the electric stapler 1 is operated, the drive rotary member 9 is rotated. Therefore, the cam follower 17 of the magazine 5 is engaged with the cam groove 21 of the drive rotary member 9, and the magazine 5 is operated downward toward the clincher section 3, so that the sheets of paper to be stapled can be clamped between the magazine section 5 and the clincher section 3. At this time, the driver plate 15 is also operated downward by the driver cam 23 via the driver link 14. However, when the shape of the cam groove 21 and that of the driver cam 23 are formed so that the motion of the magazine 5 and that of the driver plate 15 can be synchronized with each other, the magazine 5 and the driver plate 15 are not relatively moved from each other. For the above reasons, there is no possibility that the staple is driven out from the magazine 5 by the driver plate 15.

In the state in which the magazine 5 is operated to a position at which the sheets of paper to be stapled are clamped between the magazine 5 and the clincher section 3, the magazine 5 is held at the clamp position by the cam groove 21 of the drive rotary member 9. In this state, as shown in FIG. 6, the driver plate 15 is further operated downward by the driver link 14 and the driver cam 23. Due to the foregoing, the staple in the magazine 5 can be driven out from the drive section 7 formed at the forward end portion of the magazine 5. Then, the staple legs penetrating the sheets of paper to be stapled are bent by the clincher section 3 along the reverse side of the sheets of paper to be stapled. In this way, stapling is completed. After the completion of stapling, the magazine 5 and the driver plate 15 are returned upward by the cam faces 21, 23 when the drive rotary member 9 is rotated. In this way, the predetermined stapling process is completed.

Figure 7:
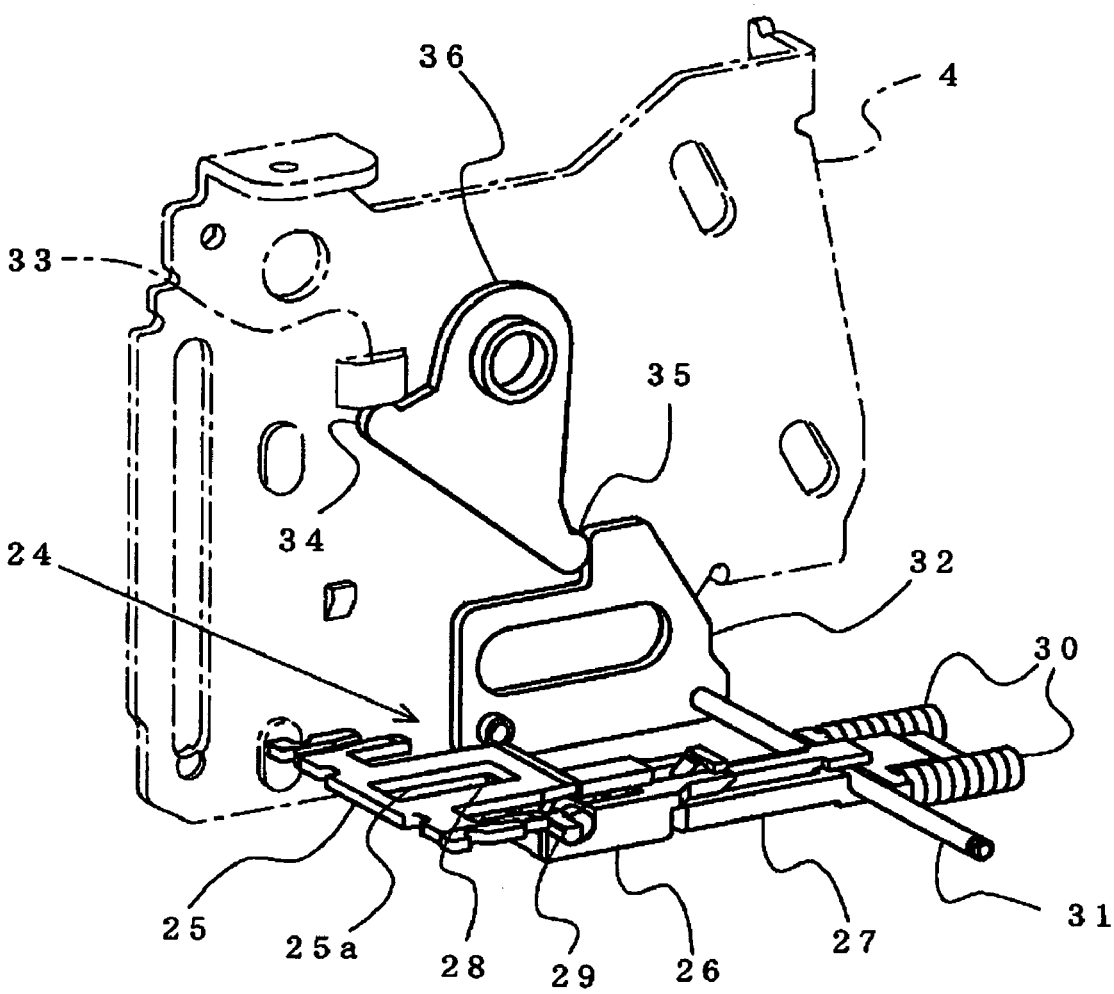
FIG. 7 is a perspective view showing a staple supply mechanism which is not operated.

As shown in FIG. 7, in the magazine 5, the staple supply mechanism 24 is provided which successively supplies the connected staples laminated and charged in the cartridge 6. This staple supply mechanism 24 is operated in relation with the sliding motion of the magazine 5 described before. The staple supply mechanism 24 includes: a supply member 26 slidably arranged along the lower face of the staple guide 25 which is formed from the staple accommodating section of the cartridge 6 toward the drive section 7; and an operation member 27 slidably formed so that the supply member 26 can be slidably operated. By the supply member 26, the pawl holder 29 is pivotally supported which holds the feed pawl 28, the forward end of which is formed into a blade-shape. In accordance with the sliding motion of the supply member 26, the pawl holder 29 is rotated and the forward end of the feed pawl 28 is engaged with the connected staples which protrude from the opening portion 25*a* formed in the staple guide 25 to the upper face side of the staple guide 25. In this way, the connected staples are supplied to the drive section.

The operation member 27 provided on the magazine 5 side is slidably supported being opposed to the supply member 26. The operation member 27 is pushed by the spring 30 so that it can slide in the direction in which the connected staples are supplied toward the drive section 7. When the operation member 27 is operated in the staple supply direction by an elastic force of the spring 30, the supply member 26 is slid in the staple supply direction so as to supply the connected staples. The operation shaft 31, both end portions of which are extended to both sides of the magazine 5, is inserted into the operation member 27. The sliding pieces 32 capable of sliding in the longitudinal direction along both sides of the magazine 5 are connected to both end portions of the operation shaft 31. Further, on both sides of the magazine 5, the engaging portions 34 engaging with the protrusions 33 formed in the support frame 4 and the rotary links 36, in which the engaging portions 35 engaging with the sliding pieces 32 are formed, are pivotally arranged.

In the state in which the electric stapler 1 is not operated, as shown in FIG. 7, when the magazine 5 is arranged at an upper position, the rotary link 36 is also arranged a tan upper position, and the engaging portion 34 of the rotary link 36 is engaged with the protrusion 33 of the support frame 4. Due to the foregoing, the rotary link 36 can be prevented from rotating clockwise. Therefore, the other engaging portion 35 of the rotary link 36 is engaged with the engaging piece 32, so that the sliding piece 32 can be prevented from moving forward and the sliding piece 32 is moved to a rear end position. Due to the foregoing, the operation member 27 connected to the sliding piece 32 via the operation shaft 31 is arranged at a rear end position while resisting a pushing force of the spring 30. Further, the supply member 26 and the pawl holder 29 held by the supply member 26 are arranged at rear positions by the operation member 27, and a forward end of the feed pawl 28 is withdrawn to the lower face side of the staple guide 25.

Figure 8:
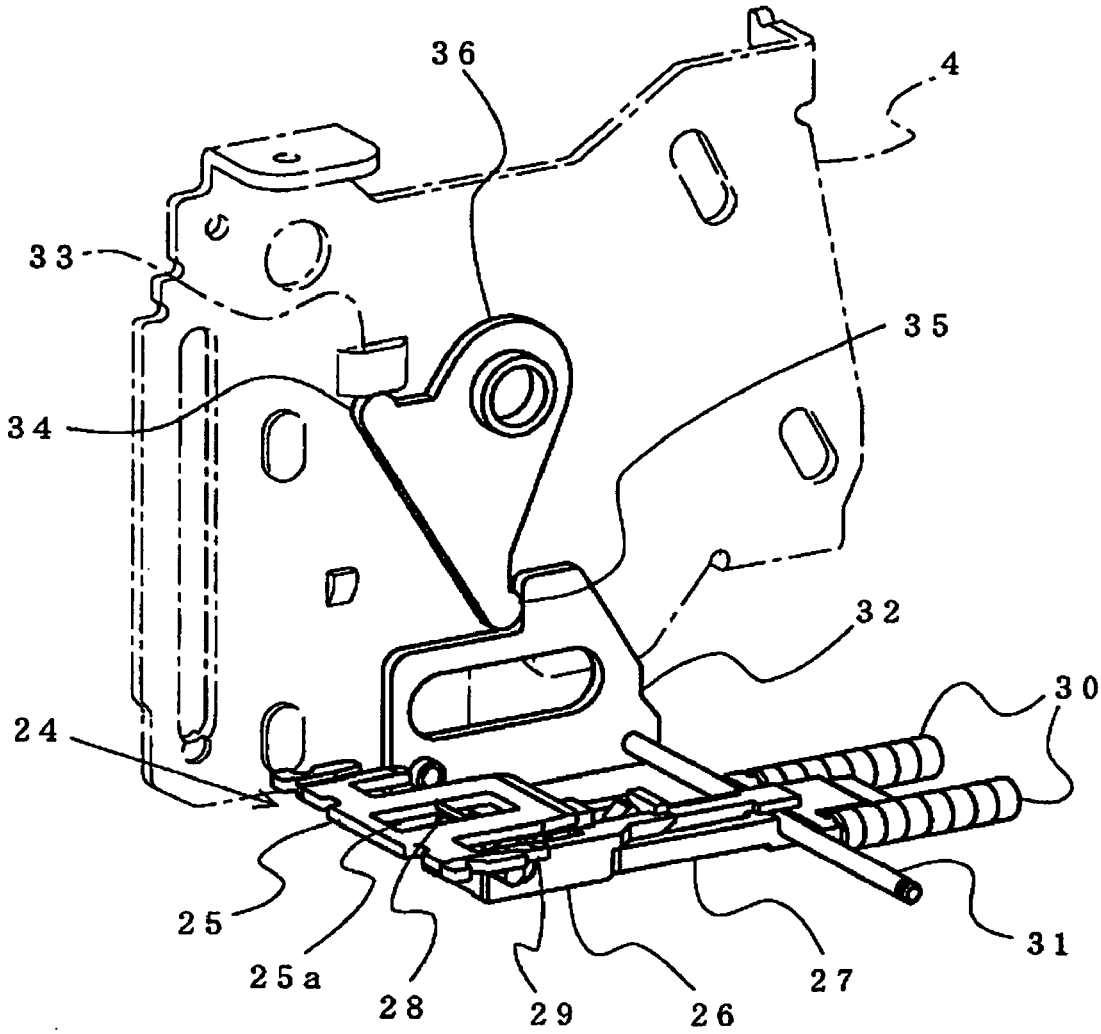
FIG. 8 is a perspective view showing a state of operation after the supply motion has been completed.

When the electric stapler 1 is operated, as shown in FIG. 8, the magazine 5 is operated downward with respect to the support frame 4 by the cam groove 21 formed in the drive rotary member 9, and the rotary link 36 supported by the magazine 5 is also moved downward with respect to the support frame 4. When the rotary link 36 is moved downward, the engaging portion 34 of the rotary link 36 is separated from the protrusion 33 of the support frame 4. Therefore, the rotary link 36 can be rotated clockwise. Therefore, the sliding piece 32, which is engaged with the other engaging portion 35 of the rotary link 36 and held at the rear end position, can be moved forward. When the sliding piece 32 can be moved, the operation member 27 is moved forward by a pushing force of the spring 30, so that the supply member 26 and the pawl holder 29 are moved forward. When the pawl holder 29 is moved forward, it is rotated and a forward end portion of the feed pawl 28, which is held by the pawl holder 29, is protruded from the opening portion 25*a* of the staple guide 25 to the upper face side and engaged with the connected staples arranged on the upper face of the staple guide 25. Therefore, the connected staples are supplied to the drive section 7.

When stapling is completed and the magazine 5 is returned to the initial position which is located in an upper portion of the support frame 4, according to the upward movement of the magazine 5, the rotary link 36 is moved upward and the engaging portion 34 of the rotary link 36 is engaged with the protrusion 33 of the support frame 4 so that the rotary link 36 can be rotated counterclockwise. Therefore, the other engaging portion 35 of the rotary link 36 engages with the sliding piece 32, and the sliding piece 32 is moved backward. When the sliding piece 32 is moved backward, the operation member 27 is moved backward via the operation shaft 31 while resisting a pushing force of the spring 30. Further, the supply member 26 and the pawl holder 29 are moved backward by the operation member 27 and returned to the initial position at which the electric stapler is not operated.

When the magazine 5 is operated by the drive rotary member 9 which drives the staple drive mechanism 8 such as a driver plate 15 and when the staple supply mechanism 24 is operated in accordance with this operation of the magazine 5, it becomes possible to extend an operation stroke of the feed pawl 28 of the staple supply mechanism 24. Therefore, when the new cartridge 6 is attached to the magazine 5 or when the connected staples are supplied to the drive section 7 after the clogging staples in the drive passage of the drive section 7 have been removed, the number of times of no-load operation of the staple supply mechanism 24 can be reduced.

INDUSTRIAL APPLICABILITY

The electric stapler of the present invention is used as an electric stapler which is arranged along a conveyance passage of conveying sheets of paper in a copier or a facsimile so as to convey the sheets of paper. Further, the electric stapler of the present invention is used as an electric stapler which is built in an after-processing device for classifying sheets of paper discharged from a device such as a copier or a facsimile and staples the sheets of paper classified by the device. Furthermore, the electric stapler of the present invention is used as an electric stapler which is not built in the above devices but used on a desk. The present invention is not limited to the electric stapler described in the above embodiment in which the sheet-shaped connected staplers are used. The present invention can be applied to an electric stapler in which connected staples, which are formed in such a manner that long connected staples are spirally wound, are charged into the magazine. Alternatively, the present invention can be applied to an electric stapler in which connected staples, which are formed in such a manner that a large number of U-shaped staples are aligned in parallel with each other, are charged into the magazine.

The invention claimed is:

1. An electric stapler comprising:

a staple drive section;

a magazine having a staple supply mechanism for supplying staples to the staple drive section and supported by a support frame;

a staple drive mechanism arranged in the magazine, for driving a staple which is supplied to the staple drive section;

a clincher mechanism arranged opposed to the staple drive section, for bending staple legs, which have penetrated sheets of paper to be stapled, along a reverse side of the sheets of paper to be stapled;

a drive rotary member;

a cam follower protruding from a side of the magazine; and a cam groove formed in the drive rotary member, for moving the magazine toward the clincher mechanism when the cam groove is engaged with the cam follower.

2. The electric stapler according to claim 1, wherein the staple drive section is formed in a cartridge in which connected staples are charged, the staple drive section has a drive passage for guiding a staple to be driven, and the cartridge is attached to the magazine.

3. The electric stapler according to claim 1, wherein the drive rotary member is pivotally supported by a support shaft outside the support frame.

4. The electric stapler according to claim 3, wherein the staple drive mechanism includes a forming plate arranged opposed to the staple drive section, and the forming plate is driven when the drive rotary member is rotated.

5. The electric stapler according to claim 1, further comprising:

a guide groove formed on an outer side of the magazine; and a guide protrusion formed on an inner side of the support frame, wherein the magazine is slidably supported being capable of sliding in the vertical direction with respect to the support frame.

* * * * *